United States Patent [19]

Jaulmes

[11] 4,276,858

[45] Jul. 7, 1981

[54] TWO-CYCLE INTERNAL COMBUSTION ENGINE

[75] Inventor: Christian Jaulmes, Paris, France

[73] Assignee: Ateliers de la Motobecane, Pantin, France

[21] Appl. No.: 117,557

[22] Filed: Feb. 1, 1980

[30] Foreign Application Priority Data

Feb. 26, 1979 [FR] France ..... 79 04842

[51] Int. Cl.[3] ..... F02B 33/04

[52] U.S. Cl. ..... 123/73 CC; 123/73 R; 123/73 A; 123/73 CB; 123/73 AF; 123/69 R; 123/69 V; 123/56 B

[58] Field of Search ..... 123/73 CC, 73 CB, 73 C, 123/73 AF, 73 AE, 73 A, 73 R, 69 R, 69 V, 56 B, 56 BA, 56 BC

[56] References Cited

U.S. PATENT DOCUMENTS

| | | | |
|---|---|---|---|
| 946,406 | 1/1910 | Sohnlein | 123/73 CB |
| 980,134 | 12/1910 | Springer | 123/73 CC |
| 1,168,425 | 1/1916 | Rosenhagen | 123/69 R |
| 1,698,757 | 1/1929 | Kjellberg | 123/73 CC |
| 2,164,234 | 6/1939 | Erren | 123/73 CB |
| 4,191,138 | 3/1980 | Jaulmes | 123/69 R |

FOREIGN PATENT DOCUMENTS

| | | | |
|---|---|---|---|
| 855637 | 11/1952 | Fed. Rep. of Germany | 123/73 CC |
| 2919172 | 11/1979 | Fed. Rep. of Germany | 123/73 C |
| 629451 | 7/1927 | France | 123/73 CB |
| 983131 | 2/1951 | France | 123/73 CB |
| 1004673 | 11/1951 | France | 123/65 R |
| 2431605 | 3/1980 | France | 123/73 CC |
| 105649 | 4/1917 | United Kingdom | 123/123 CC |
| 578638 | 7/1946 | United Kingdom | 123/73 CC |

*Primary Examiner*—Wendell E. Burns
*Attorney, Agent, or Firm*—Browdy & Neimark

[57] ABSTRACT

A two-cycle internal combustion engine includes a power cylinder, a drive piston being positioned therein. A first transfer duct extends between an auxiliary cylinder, which is supplied with carburetted air and the power cylinder and opens thereinto via a carburetted air inlet port provided on the side wall of the power cylinder or its combustion chamber. A pump crankcase, which is supplied with pure air, is connected to the power cylinder via a second transfer duct which opens thereinto via a scavenging inlet port on the side wall of the power cylinder. An exhaust port is provided on the side wall of the power cylinder. The ports are operatively arranged so that the scavenging port starts to open after the exhaust port and before the carburetted air inlet port.

9 Claims, 5 Drawing Figures

TWO-CYCLE INTERNAL COMBUSTION ENGINE

BACKGROUND OF THE INVENTION

This invention relates to improvement in two-cycle internal combustion engines.

It is known that in precompression engines the scavenging of burned gases is generally performed using fresh carburetted air, which results in low efficiency and high losses by exhaust. It is well known that this results in a great consumption of fuel and the presence of unburned hydrocarbons in the exhaust gases.

Numerous devices have already been proposed to remedy these drawbacks. These devices generally aim at performing the scavenging of the unburned gases not with fresh carburetted gases but with pure air and introducing the carburetted gases only after scavenging. This is the case, for example, with direct injection engines for which the scavenging air creates an aerodynamic screen in front of the injector. This is also the case in engines which include a balancing piston and in which, for scavenging, pure air, which has been previously compressed by the outside face of the balancing piston, is used, the pure scavenging air being fed into the main cylinder via a transfer port uncovered by the main piston ahead of the intake port coupled to the pump crankcase by which the carburetted gases are then fed into the main, power (drive) cylinder.

There are also known, particularly from British Patent Specification No. 105, 649, engines of this type, in which the pump crankcase supplies scavenging air and the auxiliary cylinder carburetted air. However, in these engines the gas mixture is introduced in the main cylinder after the exhaust and scavenging air intake ports have been closed. This introduction therefore must be performed with a high pressure, able to overcome the counterpressure that already prevails in the cylinder. Introduction of the gas mixture therefore cannot be done under good conditions.

SUMMARY OF THE INVENTION

The present invention aims at improving, from the viewpoint of fuel consumption and cleaning, the type of engine which includes at least a drive cylinder, an auxiliary cylinder and a pump crankcase and in which the auxiliary cylinder and pump crankcase are connected to the main power cylinder by the respective transfer ducts.

The present invention, which also aims at overcoming the above-mentioned shortcomings, has as its principal object the remedying of the drawback associated with the type of engine disclosed in the above-mentioned British patent specification, i.e. one which includes at least a drive cylinder, an auxiliary cylinder and a pump crankcase, the auxiliary cylinder and the pump crankcase being connected to the main power cylinder by the respective transfer ducts and devices being provided to admit pure air into the pump crankcase, while other devices are provided to admit carburetted air into the auxiliary cylinder.

In this engine, the transfer duct or ducts, between the pump crankcase and drive cylinder, is made so that its opening begins after that of the exhaust port, but before that of the transfer duct or ducts connecting the auxiliary cylinder to the main power cylinder.

Thus a double layered scavenging is obtained. In a first phase, the pump crankcase air scavenges the gases from the previous combustion and in a second phase the compressed carburetted gases in the auxiliary cylinder are transferred into the drive cylinder. The distribution can be made either by ports uncovered by the drive piston in its displacement, or by adjusted valves placed on or in the gas passageway.

A first advantage in relation of the first engine described can be seen. Actually, if the volume scavenged by the drive piston is the same as that scavenged by the auxiliary piston, which is generally the case, scavenging in the device according to the present invention is done with a volume double the volume of the gases to be scavenged. Actually, because of the presence of the auxiliary piston, the variation of the volume of the pump crankcase is equal to double the volume of one of the cylinders.

It should also be noted that in comparison with the second above-mentioned type of two-cycle engine, that of the type to which the invention refers, the introduction of the gas mixture in the main power cylinder is done under much better conditions, since this introduction is performed before the closing of the exhaust port, i.e. without counterpressure.

In an embodiment of the present invention, the auxiliary cylinder is placed 180° from the main cylinder and is provided with a buffering reservoir between the auxiliary cylinder and the main power cylinder.

The presence of the buffering reservoir is actually essential in this configuration, because the precompression of the carburetted gases in the auxiliary cylinder is produced at the same time as the compression of the mixture in the drive cylinder. It will be noted, however, that the buffering reservoir can be the gas transfer duct itself. In this configuration, the intake in the main power cylinder of the carburetted gases will generally begin before closing of the exhaust port. However, the layering of the gases and the geometry of the transfer ducts are such, that the carburetted gases do not escape directly via the exhaust port. An advantage of this embodiment resides in the fact that the auxiliary piston can also act as a balancing piston.

In another advantageous embodiment of the present invention, the auxiliary cylinder is placed 90° from the main power cylinder, the two crankheads being mounted on the same crankpin and a balancing counterweight being provided opposite this crankpin.

It is also known that in this configuration it is possible to obtain balancing of the engine as in the preceding case. In this configuration, the gases will generally be injected only after a certain rise of the drive piston, so that there is a counterpressure, albeit relatively low, in the drive cylinder opposing the intake of the carburetted gases. However, this is not troublesome to the extent that the auxiliary piston is in advance in relation to the main piston and consequently it is in the vicinity of top dead center at the moment of intake of carburetted gases, therefore at the moment when the latter are admitted into the drive cylinder.

In another variant, it can be provided that the transfer duct between the auxiliary cylinder and main power cylinder opens into the combustion chamber of the latter.

This is particularly advantageous in the case where the main power cylinder and auxiliary cylinder form an acute angle between them, since it is then possible to assure scavenging of the main power cylinder with pure air up to the time of closing of the exhaust port. The carburetted mixture is injected at the end of compression in the vicinity of the sparkplug and just before the ignition point to burn first this mixture close to the stoichiometry, then to propagate the combustion in the residual pure, scavenging air. In this way it is assured that no carburetted gas is lost in the exhaust.

BRIEF DESCRIPTION OF THE DRAWINGS

In any case, the present invention is to be better understood from the following description of embodiments given by way of non-limiting examples. In the accompanying drawings.

DETAILED DESCRIPTION OF THE PREFERRED EMBODIMENTS

Figure 1:
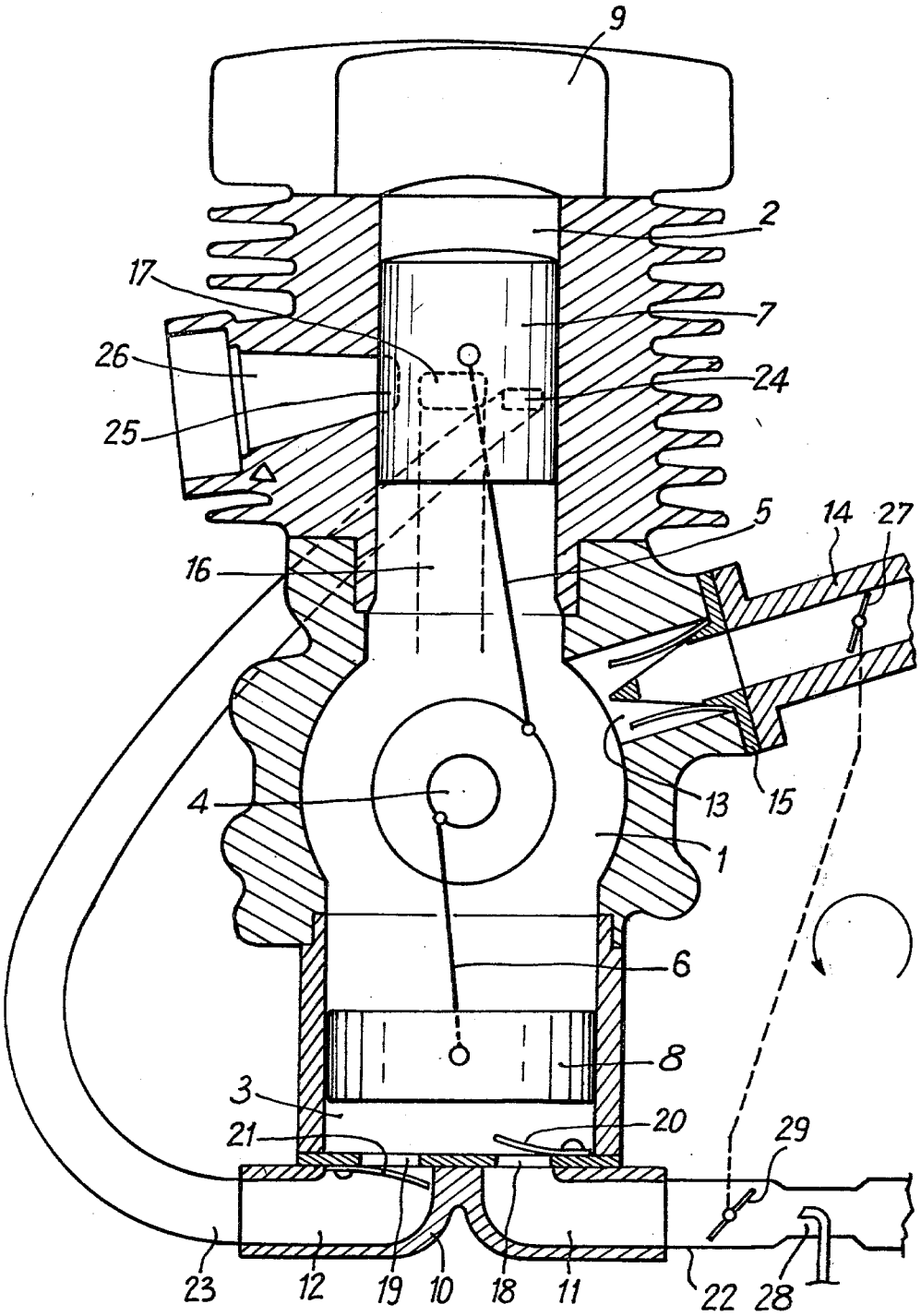
FIG. 1 is a detailed, sectional view of a first embodiment of an improved two-cycle engine in accordance with the present invention.
Figure 3:
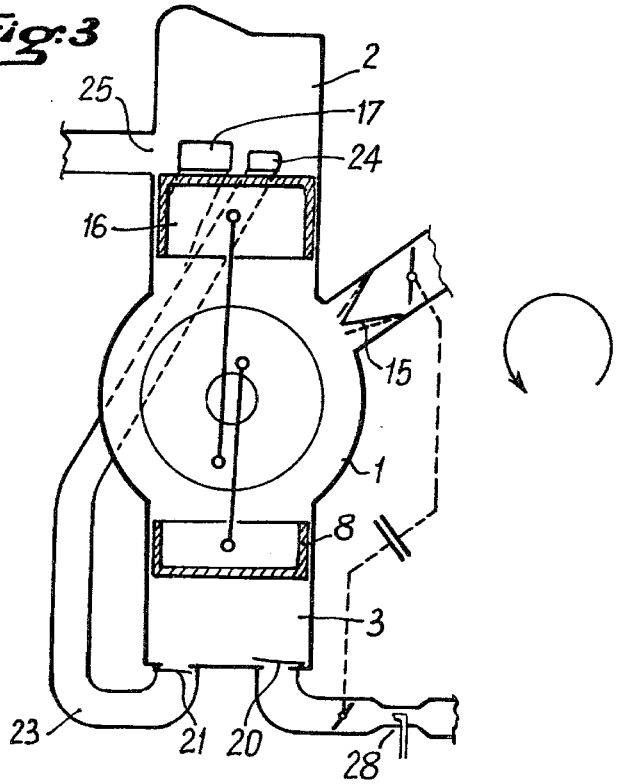
FIG. 3 is a schematic representation of the engine of FIG. 1.

As shown in FIGS. 1 and 3, an engine according to the present invention includes a pump crankcase 1, a main power (drive) cylinder 2 and an auxiliary cylinder 3. A crankshaft 4 is mounted in the crankcase 1, this crankshaft carrying, on opposite crankpins, crankheads 5 and 6, respectively, of a drive piston 7, which moves in the power cylinder 2, and of an auxiliary piston 8, which moves in the auxiliary cylinder 3. The power cylinder 2 is closed by a cylinder head 9, while the cylinder 3 is closed by an auxiliary manifold 10, forming an intake chamber 11 and a discharge chamber 12, whose function is to be described below.

The crankcase 1 includes an intake port 13, connected to an intake manifold 14 via a symmetrical plate valve 15. Further, the pump crankcase 1 is connected to the power cylinder 2 by a transfer duct 16 opening into the power cylinder 2 via an intake port 17. The auxiliary cylinder 3 is connected to the intake chamber 11 via a port 18 and to the discharge chamber 12 via a port 19. The port 18 is controlled by a valve 20, which opens inwardly into the inside of the auxiliary cylinder 3, while the port 19 is controlled by a valve 21, which opens inwardly into the inside of the discharge chamber 12. Further, the intake chamber 11 is connected to an intake duct 22 and the discharge chamber 12 is connected to the power cylinder 2 via a transfer duct 23, which opens into the power cylinder 2 via an intake port 24. The power cylinder 2 also includes an exhaust port 25, with which an exhaust duct 26 communicates. The intake ports 17 and 24 and the exhaust port 25 are placed so that the upper edge of the port 25, i.e. the edge closest to the cylinder head 9 is higher than the upper edge of the port 17, which is higher than the upper edge of the port 24.

The intake duct 14 in the pump crankcase 1 is connected directly to the air filter and is controlled by an intake flap 27. Intake duct 22 is connected to the air filter by carburetor 28 and is controlled by an intake flap 29. Intake flaps 27 and 29 operate in parallel.

Figure 2:
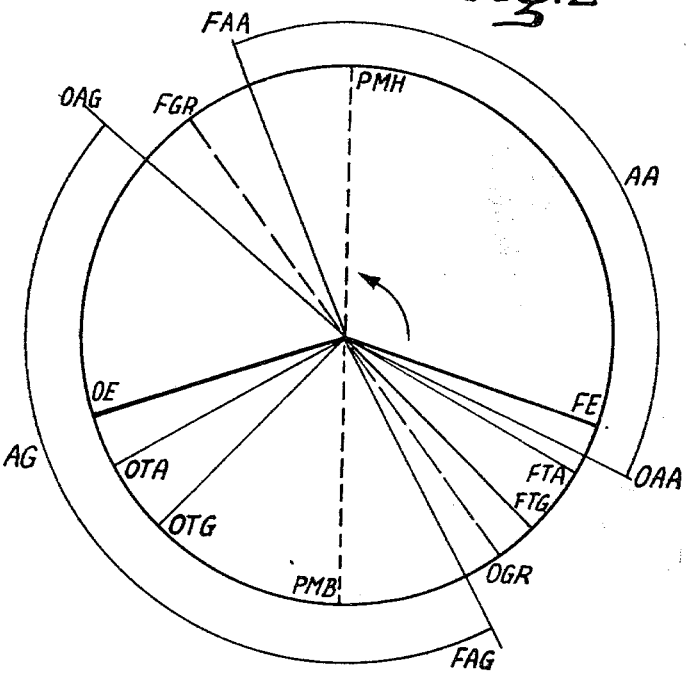
FIG. 2 is an operating diagram of the engine of FIG. 1.

The operation of the engine described above is now to be described, with reference to the operating diagram of FIG. 2. From top dead center PHM and in the direction of rotation indicated by the arrow, the drive piston 7 descends in the power cylinder 2 to the point OE of opening of the exhaust port 25. At this instant, the burned gases begin to escape through the exhaust manifold 26. When the point OTA of opening of the air intake port 17 is reached, the compressed pure air in the pump crankcase 1 is transferred into the power cylinder 2 via the transfer duct 16 and drives out the burned gases through the exhaust manifold 26. Only when the point of opening OTG of the intake port 24 is reached, do the carburetted gases compressed in the preceding cycle in the auxiliary cylinder 3 and transferred via valve 21 into the transfer duct 23 penetrate into the power cylinder 2 through the intake port 24. The drive piston 7 then passes through its bottom dead center and ascends to the point of closing FTG of the gas intake port 24, then to the point of closing FTA of the air intake port 17 and to the point of closing FE of the exhaust port 25, at which point compression begins to reach again the top dead center PMH. Intake of pure air in the pump crankcase 1, via the valve 15, is effected during the period represented by arcuate section AA between the point of opening OAA of the air intake port and the point of closing FAA of the air intake port. Intake of gases into the auxiliary cylinder 3 via the valve 20 is performed is performed during the period represented by arcuate section AG opposite the arcuate section AA between the point of opening OAG of the gas intake port, and the point of closing FAG of the gas intake port. It has been established in a standard way for an engine with distribution controlled by the piston port unit, that the distribution diagram, shown in FIG. 2, is symmetric and that, also in a standard way for an engine with intake by valve, the intake diagram is asymmetric. However, there are two separate intake diagrams for the air taken in by pump crankcase 1 and the carburetted gases taken in by auxiliary cylinder 3.

Figure 4:
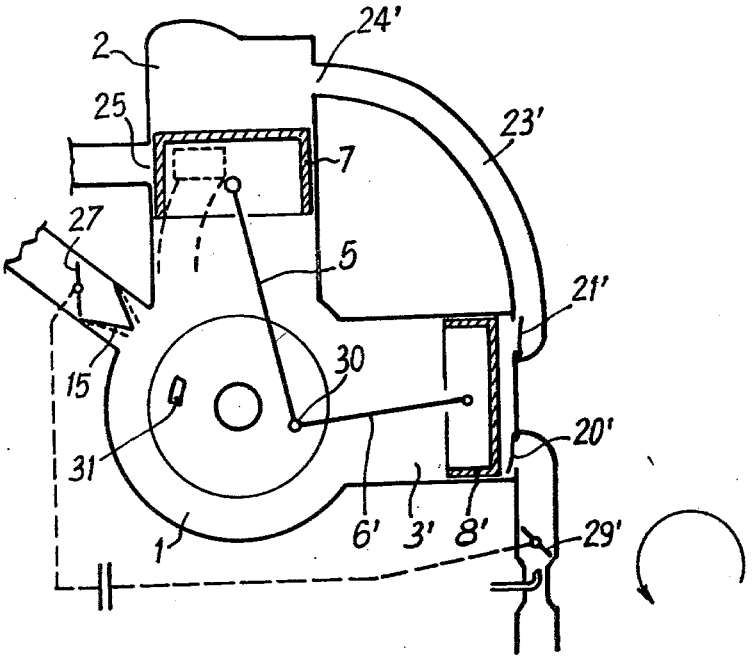
FIGS. 4 and 5 are schematic views similar to FIG. 3 of two variants of the improved two-cycle engine in accordance with the present invention.

In the embodiment shown in FIG. 4, an auxiliary cylinder 3' is positioned 90° from a power cylinder 1. A connecting rod 5 of a drive piston 7 and a connecting rod 6' of an auxiliary piston 8' are mounted on a single crankpin 30 and a counterweight 31 is provided at the opposite end of the crankpin 30 to assure balancing of the engine. Further, a transfer duct 23' between the auxiliary cylinder 3' and a main power cylinder 2 has a port 24' placed above an exhaust port 25'. Transfer of carburetted gases between the auxiliary cylinder 3' and power cylinder 2 is controlled by an adjusted valve 21' so that it is possible to take the carburetted gases into the power cylinder 2 only after closing of the exhaust port 25 and thus any lost of carburetted gas is avoided.

Figure 5:
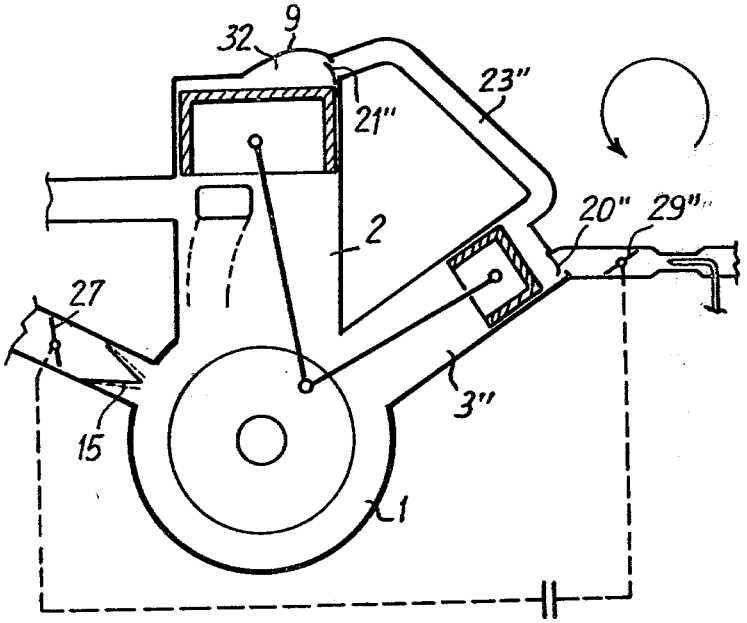

In the embodiment shown in FIG. 5 an auxiliary cylinder 3'' forms an acute angle with a power cylinder 2. Under these conditions, only an approximate balancing can be achieved. A transfer duct 23'' between an auxiliary cylinder 3'' and a power cylinder 2 opens into a combustion chamber 32 of the latter. A valve 21'' of this transfer duct 23'' can then be placed, as shown, directly on a cylinder head 9 of the power cylinder 2.

The functioning of the engines described with reference to FIGS. 4 and 5 respectively are similar to that of the engine described with reference to FIGS. 1–3, i.e., the pure air is taken into the pump crankcase 1 by intake valves 15 and the carburetted air is taken into auxiliary cylinders 3' and 3'' respectively by intake valves 20' and 20'', respectively. A pure air intake flap 27 and carburetted air flap 29'' also operate in parallel.

It goes without saying, the invention is not limited to the embodiments and variants described above, but rather embraces all possible embodiments and variants falling within the scope of the appended claims.

What is claimed is

1. A two cycle internal combustion engine comprising at least one power cylinder; a drive piston in said power cylinder; at least one auxiliary cylinder; at least one first transfer duct extending between said auxiliary cylinder and said power cylinder; at least one second transfer duct extending between said pump crankcase and said power cylinder; means for intaking carburetted air into said auxiliary cylinder; means for intaking pure air into said pump crankcase; an exhaust port from said power cylinder; a scavenging intake port opening into said power cylinder; and a carburetted air intake port opening into said power cylinder, said exhaust port, said scavenging port and said carburetted air inlet port being so positioned that said scavenging port starts to open after said exhaust port and before said carburetted air intake port.

2. An engine according to claim 1, including adjusted valve means for controlling fluid communication from said auxiliary cylinder to said first transfer duct.

3. An engine according to claim 1 or claim 2, wherein said exhaust port, said scavenging intake port and said carburetted air intake port are provided in the side wall of said power cylinder whereby opening and closing of these ports is controlled by displacement of said drive piston.

4. An engine according to claim 3, wherein said auxiliary cylinder is positioned 180° from said power cylinder, said first transfer duct being a buffering between said auxiliary cylinder and said power cylinder.

5. An engine according to claim 3, wherein said auxiliary cylinder is positioned 90° from said power cylinder, and including a single crank pin; two crankheads, each of said crankheads being mounted on said single crankpin; and a counterweight mounted angularly opposite said crankpin.

6. An engine according to claim 3, wherein said carburetted air outlet port opens into the combustion chamber of said power cylinder.

7. An engine according to either claim 1 or claim 2, wherein said auxiliary cylinder is positioned 180° from said power cylinder, said first transfer duct being a buffering reservior between said auxiliary cylinder and said power cylinder.

8. An engine according to either claim 1 or claim 2, wherein said auxiliary cylinder is positioned 90° from said power cylinder, and including a single crank pin; two crankheads, each of said crankheads being mounted on said single crankpin; and a counterweight mounted angularly opposite said crankpin.

9. An engine according to either claim 1 or claim 2, wherein said carburetted air inlet port opens into the combustion chamber of said power cylinder.

* * * * *